US011484779B2

(12) United States Patent
Perez et al.

(10) Patent No.: US 11,484,779 B2
(45) Date of Patent: Nov. 1, 2022

(54) DYNAMIC GAMEBOARD

(71) Applicant: Zerep Holdings, LLC, Avinger, TX (US)

(72) Inventors: Marcus Perez, Avinger, TX (US); Aram Perez, East Ridge, TN (US); Triston Clark, Avinger, TX (US); Celton O'Garro, Jefferson, TX (US); Aiden Perez, Aveinger, TX (US)

(73) Assignee: Zerep Holdings, LLC, Avinger, TX (US)

( * ) Notice: Subject to any disclaimer, the term of this patent is extended or adjusted under 35 U.S.C. 154(b) by 65 days.

(21) Appl. No.: 16/908,613

(22) Filed: Jun. 22, 2020

(65) Prior Publication Data

US 2021/0394043 A1 Dec. 23, 2021

(51) Int. Cl.
*A63F 3/00* (2006.01)

(52) U.S. Cl.
CPC ..... *A63F 3/00097* (2013.01); *A63F 3/00214* (2013.01); *A63F 3/00643* (2013.01); *A63F 2003/00182* (2013.01); *A63F 2003/00646* (2013.01); *A63F 2003/00662* (2013.01)

(58) Field of Classification Search
CPC ..... A63F 3/00097; A63F 3/00214; A63F 3/00643; A63F 2300/00182; A63F 2003/00646; A63F 2003/00662
See application file for complete search history.

(56) References Cited

U.S. PATENT DOCUMENTS 6,257,575 B1 * 7/2001 Ortega ..... A63F 3/00214 273/241
10,307,661 B2 * 6/2019 Dandamudi ..... A63F 13/235
2013/0217496 A1 * 8/2013 Olkin ..... A63F 3/00697 463/32

* cited by examiner

*Primary Examiner* — William H Mcculloch, Jr.
*Assistant Examiner* — Ankit B Doshi
(74) *Attorney, Agent, or Firm* — Holoubek Patent Law, LLC; Charlotte Holoubek

(57) ABSTRACT

A dynamic gameboard comprising an electronic control system and a board having a plurality of dynamic board pieces, wherein the electronic control system includes a server, lift control board and a user interface, the server having a first processor, a first memory, and a first communication device, wherein instructions are stored on the first memory to cause the first processor to direct the lift control board to instruct the plurality of dynamic board pieces to move between a first position and a second position, and between the second position and the first position, where the first position is a fully extended up position and the second position is a fully recessed down position; the lift control board having a second processor, a second memory, and a second communication device, and the user interface having a third processor, a third memory, and a third communication device.

18 Claims, 11 Drawing Sheets

DYNAMIC GAMEBOARD

BACKGROUND

A physical game generally requires a combination of the mental and physical ability and requires the player to be aware of a goal to be achieved by playing the game. There are several games, such as, a mini golf course, a maze course, an obstacle course, etc., that are currently known which has a plurality of obstacles that a player needs to navigate during play. However, a path and the associated obstacles in these games are static and cannot be changed without manual intervention. Once the game is solved the first few times, players acquire the necessary knowledge to complete the game successively, losing with it interest in the game, which causes the game to lose values in the eyes of the game player and game owners.

SUMMARY

Wherefore, it is an object of the present invention to overcome the above-mentioned shortcomings and drawbacks associated with the current technology.

The present disclosure relates, generally, to gameboards. More particularly, the present disclosure relates to dynamic gameboards having a plurality of dynamic board pieces adapted to move between an extended position and a recessed position.

The present invention relates to methods and dynamic gameboards comprising an electronic control system and a board having a plurality of dynamic board pieces, wherein the electronic control system includes a server, lift control board and a user interface, the server having a first processor, a first memory, and a first communication device, wherein instructions are stored on the first memory to cause the first processor to direct the lift control board to instruct the plurality of dynamic board pieces to move between a first position and a second position, and between the second position and the first position, where the first position is a fully extended up position and the second position is a fully recessed down position; the lift control board having a second processor, a second memory, and a second communication device, and the user interface having a third processor, a third memory, and a third communication device. According to a further embodiment, the plurality of dynamic board pieces includes a plurality of tiles and a respective lift mechanism that raises and lowers each tile. According to a further embodiment, the tile has a substantially planar top surface and substantially planar side surfaces, and the top surface is shaped as one of a right triangle, an equilateral triangle, a triangle with two interior angles measuring 45 degrees, a square, a pentagon, a hexagon, a trapezoid, and a regular polygon. According to a further embodiment, the lift mechanism includes one of a pneumatic piston, a hydraulic piston, a lead screw, a scissor lift, a linear actuator, rack and pinon, a worm screw, a servo, and a geared servo. According to a further embodiment, the lift mechanism including three lead screws arranged at a periphery of the tile, and a stepper motor functionally connected to the three lead screws via a belt. According to a further embodiment, the lift mechanism including a scissor lift, a servo, and a spring, wherein the spring one of biases the scissor lift in the first position and biases the scissor lift in the second position, and wherein the lift mechanism allows collapse under object weight to the second position. According to a further embodiment, the plurality of tiles is arranged such that when one or more tiles are raised adjacent to one or more tile that is lowered, the raised tiles define a wall and the lowered tiles defines a floor. According to a further embodiment, the dynamic gameboard further comprises sensors that sense movement of an object across the board, wherein the sensors relay data to the second processor and instructions stored in the second memory direct one or more of the plurality of tiles to move in an upward or downward position in response to sensor data. According to a further embodiment, the sensors are embedded in one or more of the plurality of tiles. According to a further embodiment, the second memory stores instructions to direct one or more of the plurality of tiles to continuously move between the first position and the second position. According to a further embodiment, the second memory stores instructions to direct one or more of the plurality of tiles to move to and maintain for a period of time a position that is between the up position and down position. According to a further embodiment, the board supports an adult human weight standing on the board when the tiles are both in the first position and the second position. According to a further embodiment, the tiles are spring biased to the second position.

The present invention further relates to devices and methods for a user to operate a dynamic gameboard, the dynamic gameboard having an electronic control system and board, the board having a plurality of dynamic board pieces, the method comprising connecting to a server via a user interface over a network, the server including a first processor, a first memory, and a first communication device, the user interface including a display; an input device, a third processor, a third memory, and a third communication device, the first communication device adapted to facilitate a communication and data exchange between the server and the user interface and between the server and a lift control board, and the third communication device adapted to facilitate a communication and data exchange between the user interface and the server, the lift control board having a second processor, a second memory, and a second communication device, the second communication device adapted to facilitate a communication and data exchange between the lift control board and the server; the first processor accessing, via the first memory, one or more locations at which a board is available, and sending the one or more locations from the server to the user interface; selecting on the user interface a chosen location via the input device, and sending the location from the user interface to the server; the first processor accessing, via the first memory, one or more maps available to play at the chosen location and sending the one or more maps from the server to the user interface; selecting on the user interface a map among the one or more maps via the input device, and sending a map selection from the user interface to the server; the first processor associating the selected map to a board at the selected location; the first processor sending a file associated to the selected map from the first memory to second processor of the lift control board, and the lift control board storing the map file in the second memory; and after receiving the file associated with the map, the second processor starts a timer, and positions one or more tiles to provide one or more paths to a player to navigate a course to reach a final position from an initial position and to provide obstructions in as raised dynamic board pieces in the path of the player; where a first position of a tile is a fully extended up position and a second position of the tile is a fully recessed down position. According to a further embodiment, the second processor, in communication with the first processor and according to the file associated with the map, moves one or more tiles to a fully recessed position, to a fully extended position, or a position between the fully extended position or the fully recessed position as directed by the map by sending commands to associated actuators of the dynamic board pieces. According to a further embodiment, the second processor changes positions of the one or more tiles of the dynamic board pieces based on a time elapsed since the start of the timer as defined by the selected map. According to a further embodiment, the second processor receives sensor data associated with one of a position of the user or another object on the board, a direction of movement of the user or another object on the board, and a speed of movement of the user or another object, and based on the sensor data changes a position of one or more tiles of the dynamic board pieces to dynamically change a path to be navigated by the user to reach a final position. According to a further embodiment the method further comprises the second processor continuing to monitor the timer and calculate a time duration from an initiation of play, and indicating an end of game upon an elapse of a predetermined time duration, the second processor storing a total time taken by the player to reach the final position for a game and sharing a time duration information with the server, which stores the time duration information in the first memory; and upon completion of the game, the second processor or the first processor indicating and end of the play and moving the board to an off position by the second processor or the first processor moving all the tiles to the second position, and subsequently switching off the board by moving each switch in the lift control board to disable power to associated actuator assemblies. According to a further embodiment, the method further comprises the first processor prompting the user, via the user interface, for making a requisite payment, and upon receiving the requisite payment, first processor sending a signal to switch on the board to receive the file associated with the map and to enable a delivery of power to associated actuator assemblies; and before sharing the map file with the second processor, the first processor communicates with the lift control board and checks if the board is switched on or switched off, and in response to the switched off condition of the board, the first processor sends a signal to the second processor to switch on the board to enable a delivery of power to an actuator assembly of a lift mechanism of each dynamic board piece.

The present invention is further related to methods and dynamic gameboards comprising an electronic control system including a server, lift control board and a user interface; a board having a plurality of dynamic board pieces; wherein the electronic control system includes a server, lift control board and a user interface, the server having a first processor, a first memory, and a first communication device, wherein instructions are stored on the first memory to cause the first processor to direct the lift control board to instruct the plurality of dynamic board pieces to move between a first position and a second position, and between the second position and the first position, where the first position is a fully extended up position and the second position is a fully recessed down position; the lift control board having a second processor, a second memory, and a second communication device, and the user interface having a first processor, a first memory, and a first communication device; the dynamic board piece includes a plurality of tiles and a respective lift mechanism that raises and lowers each tile; the tile has a substantially planar top surface and substantially planar side surfaces, and the top surface is shaped as one of a right triangle, an equilateral triangle, a triangle with two interior angles measuring 45 degrees, a square, a pentagon, a hexagon, a trapezoid, and a regular polygon; the lift mechanism includes one of three lead screws arranged at a periphery of the tile, and a stepper motor functionally connected to the three lead screws via a belt, a scissor lift, a servo, and a spring, wherein the spring one of biases the scissor lift in the first position and the second position, a pneumatic piston, a hydraulic piston, a rack and pinon, a worm screw, and a geared servo; the plurality of tiles is arranged such that when one or more tiles are raised adjacent to one or more tile that is lowered, the raised tiles create a wall and the lowered tiles create a floor; sensors that sense movement of an object across the board, wherein the sensors relay data to the second processor and instructions stored in the second memory direct one or more of the plurality of tiles to move in an upward or downward position in response to sensor data, and the sensors are embedded in one or more of the plurality of tiles; the second memory stores instructions to direct one or more of the plurality of tiles to continuously move between the up position and down position; the second memory stores instructions to direct one or more of the plurality of tiles to move to and maintain for a period of time a position that is between the first position and second position, the period of time being one of between 1 and 5 seconds, 30 seconds and 2 minutes, and greater than 2 minutes; and the board supports a 200 pound adult human standing on the board when the tiles are both in the up position and the down position. In further embodiments, such as dynamic gameboards that are intended to support only non-human objects, such as small robots, the board could be designed to lift and support 5, 10, 15, 20, or 25 pounds, for example.

According to a further embodiment, partially raised tiles can create an upward or downward ramped path.

According to a further embodiment one or more of the tiles move dynamically during gameplay creating dynamic movement of dynamic obstacles like flowing waves, spinning windmills, turbulent hurricane areas, and snakes roaming the board may be coded. By raising and lowering adjacent tiles, walls and dynamic obstacles may be made to appear to move across the board in defined, predictable or random directions, at various speeds. These may be time-based movements and take no sensor inputs, or could be responsive to sensor inputs, or both, mimicking motions of familiar, real-life objects increasing dynamic gameplay.

According to a further embodiment, the sensors can detect the map's conclusion (for example, golf ball in hole) and change the board accordingly, and additionally notify the players, through the user interface, for example.

According to a further embodiment, the user interface and interactions allow for two or more players to co-play: that while one player is on the gameboard playing, a second player can also interact (via a user interface) with the obstacles on the gameboard. This allows a second player to be either a teammate, where (in one embodiment) the first user cannot win without this second player's help in moving obstacles, or a competitor, with the second player working to hinder progress of the first player by enabling obstacles.

According to a further embodiment, the game digitally represented on a screen is made physically available in the real-world.

According to a further embodiment, the tiles are told to move to a static position (the map) until the game play timer has expired, with game play lasting 10 to 20 minutes, for example. After those static positions are reached (e.g., the map is achieved), then dynamic actions/game play occurs, in which tiles may be told to move up and down in patterns, generally taking 4-30 seconds between the up and down positions.

According to a further embodiment, the functions of the server and the lift control board may be performed by a single unit, with a same processor, memory, and same communication device. In an exemplary version of such embodiment, the user interface and lift control board could be communicating directly with each other, and all instructions could be stored on the lift control board memory, and a separate server could be omitted.

Various objects, features, aspects, and advantages of the present invention will become more apparent from the following detailed description of preferred embodiments of the invention, along with the accompanying drawings in which like numerals represent like components. The present invention may address one or more of the problems and deficiencies of the current technology discussed above. However, it is contemplated that the invention may prove useful in addressing other problems and deficiencies in a number of technical areas. Therefore, the present invention should not necessarily be construed as limited to addressing any of the particular problems or deficiencies discussed herein

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. It is to be appreciated that while the accompanying drawings are to scale for some embodiments of the present invention, the emphasis is instead placed on illustrating the principles of the invention. The invention will now be described, by way of example, with reference to the accompanying drawings in which.

DETAILED DESCRIPTION

Figure 1:
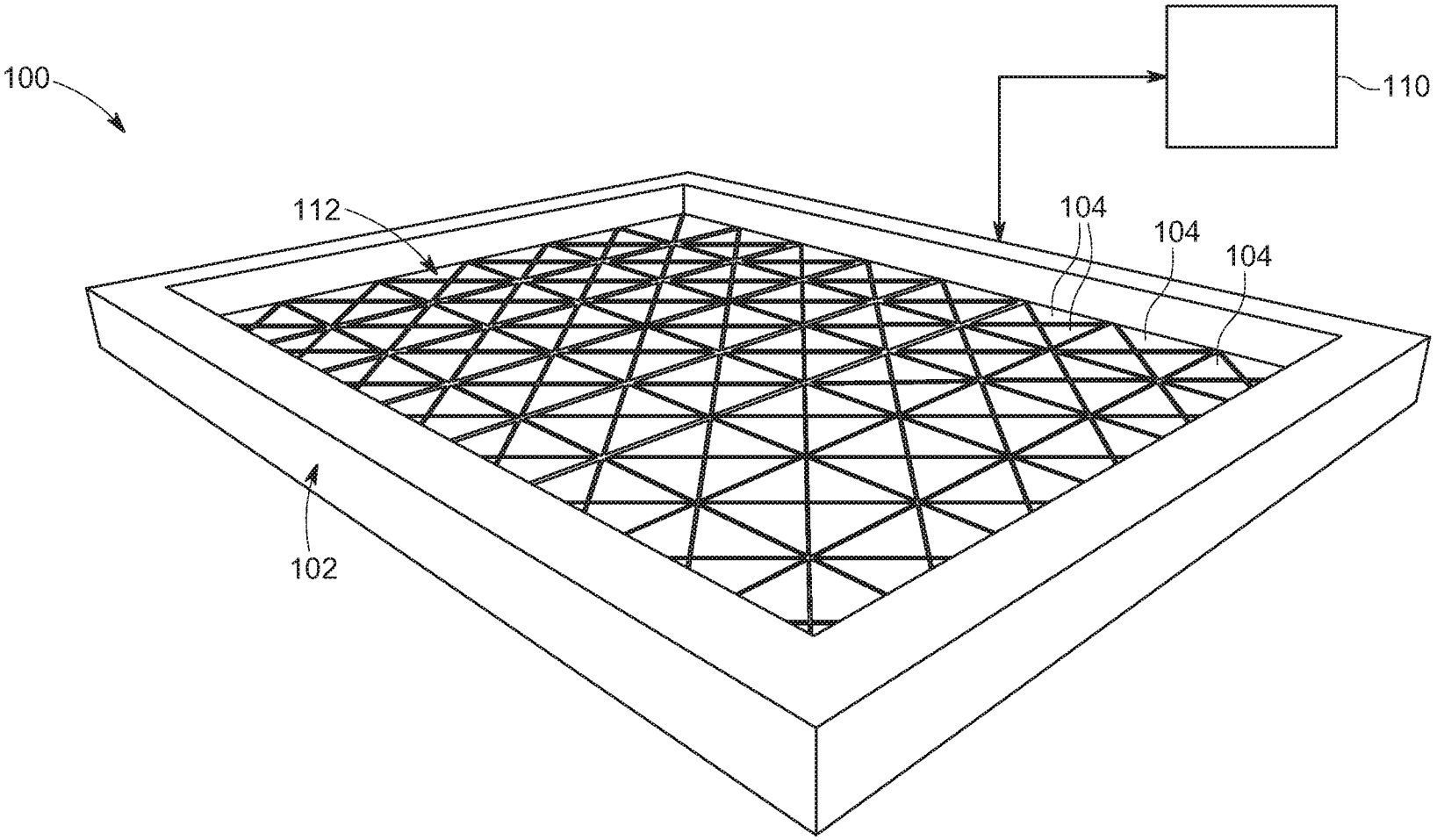
FIG. 1 illustrates a schematic view of a dynamic gameboard depicting a board with each of the plurality of dynamic board pieces disposed in a fully recessed position and an electronic control system, in accordance with an embodiment of the disclosure.

The present invention will be understood by reference to the following detailed description, which should be read in conjunction with the appended drawings. It is to be appreciated that the following detailed description of various embodiments is by way of example only and is not meant to limit, in any way, the scope of the present invention. In the summary above, in the following detailed description, in the claims below, and in the accompanying drawings, reference is made to particular features (including method steps) of the present invention. It is to be understood that the disclosure of the invention in this specification includes all possible combinations of such particular features, not just those explicitly described. For example, where a particular feature is disclosed in the context of a particular aspect or embodiment of the invention or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm. The embodiments set forth the below represent the necessary information to enable those skilled in the art to practice the invention and illustrate the best mode of practicing the invention. In addition, the invention does not require that all the advantageous features and all the advantages need to be incorporated into every embodiment of the invention.

Figure 2:
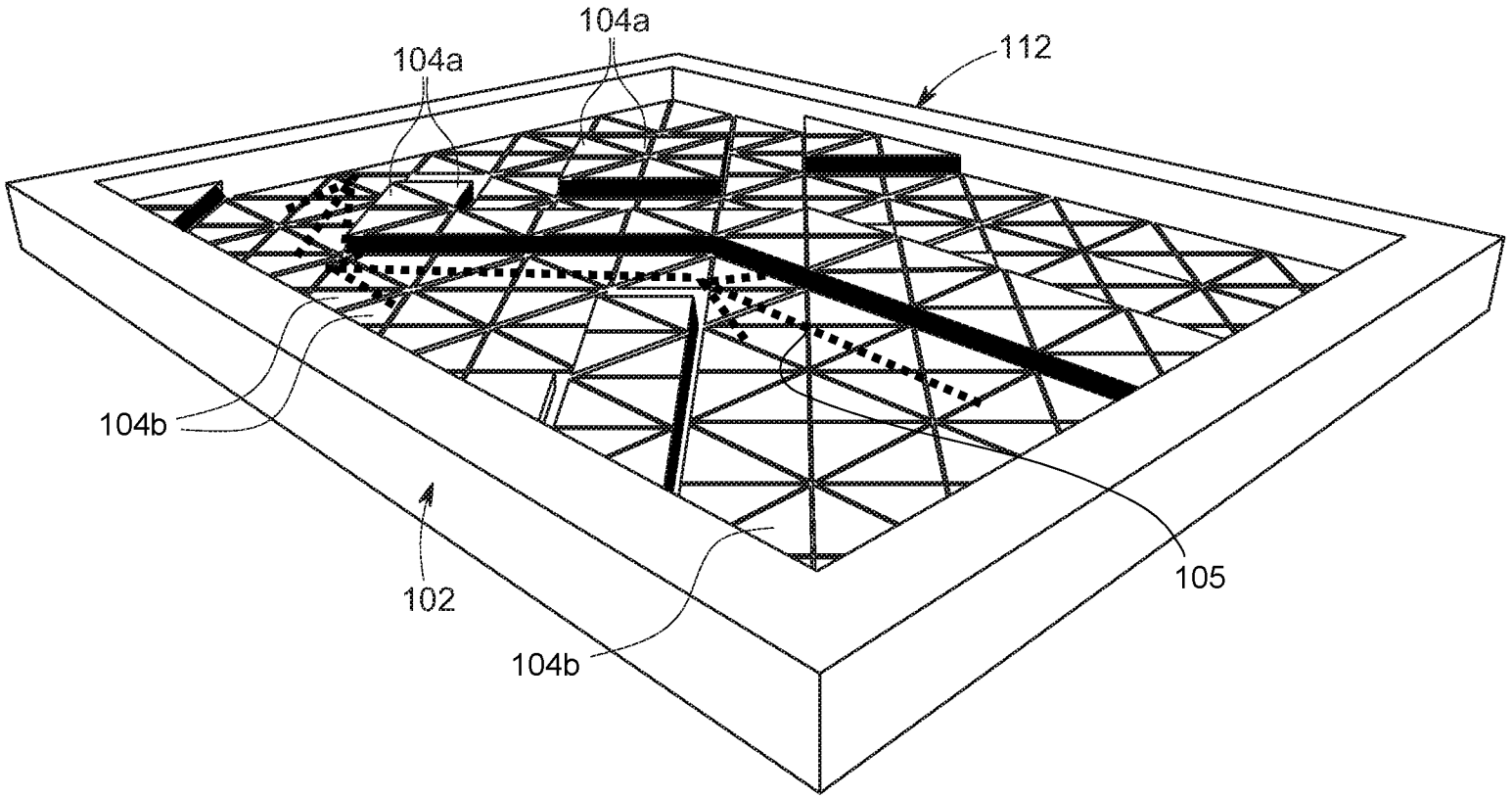
FIG. 2 illustrates a schematic view of the board of FIG. 1 of depicting some of the plurality of dynamic board pieces in a fully extended position, in accordance with an embodiment of the disclosure.

Reference will be made to the figures, showing various embodiments of a gameboard and methods for operating thereof. Referring to FIG. 1, a schematic view of a dynamic gameboard 100 (hereinafter referred to as a gameboard) suitable for enabling a playing of one or more persons is shown. The gameboard 100 includes a board 102 having a plurality of dynamic board pieces 104 and an electronic control system 110 to control movements of each of the plurality of dynamic board pieces 104. Referring to FIGS. 1 and 2, the dynamic board pieces 104 are arranged adjacent and abutting each other to define a playing surface 112, and are adapted to move in a vertical direction between a fully extended first position, shown in FIG. 2, wherein the dynamic board piece 104 creates an obstacle wall 104*a*, and a fully recessed second position, where the dynamic board piece 104, defines a floor 104*b* of the board 102, which facilitates a movement of a player or other object over the playing surface 112. Together the dynamic board pieces in the first position—walls 104*a*—and dynamic board pieces in the second position—floor 104*b*—define a path 105. The one or more dynamic board pieces 104 of the plurality of dynamic board pieces 104, when disposed in the first position or between the first position or the second position, provides an obstacle 104*a* to the movement of the player and/or other object over the playing surface 112. The vertical motion of each dynamic board piece 104 is controlled by the electronic control system 110 (explained later). Further, it may be appreciated that each of the plurality of dynamic board pieces 104 may be similar in structure, assembly, construction, and functionality and for the sake of clarity and brevity, the structure, the construction, the assembly, and the functionality are explained with reference to a single dynamic board piece 104.

Figure 3:
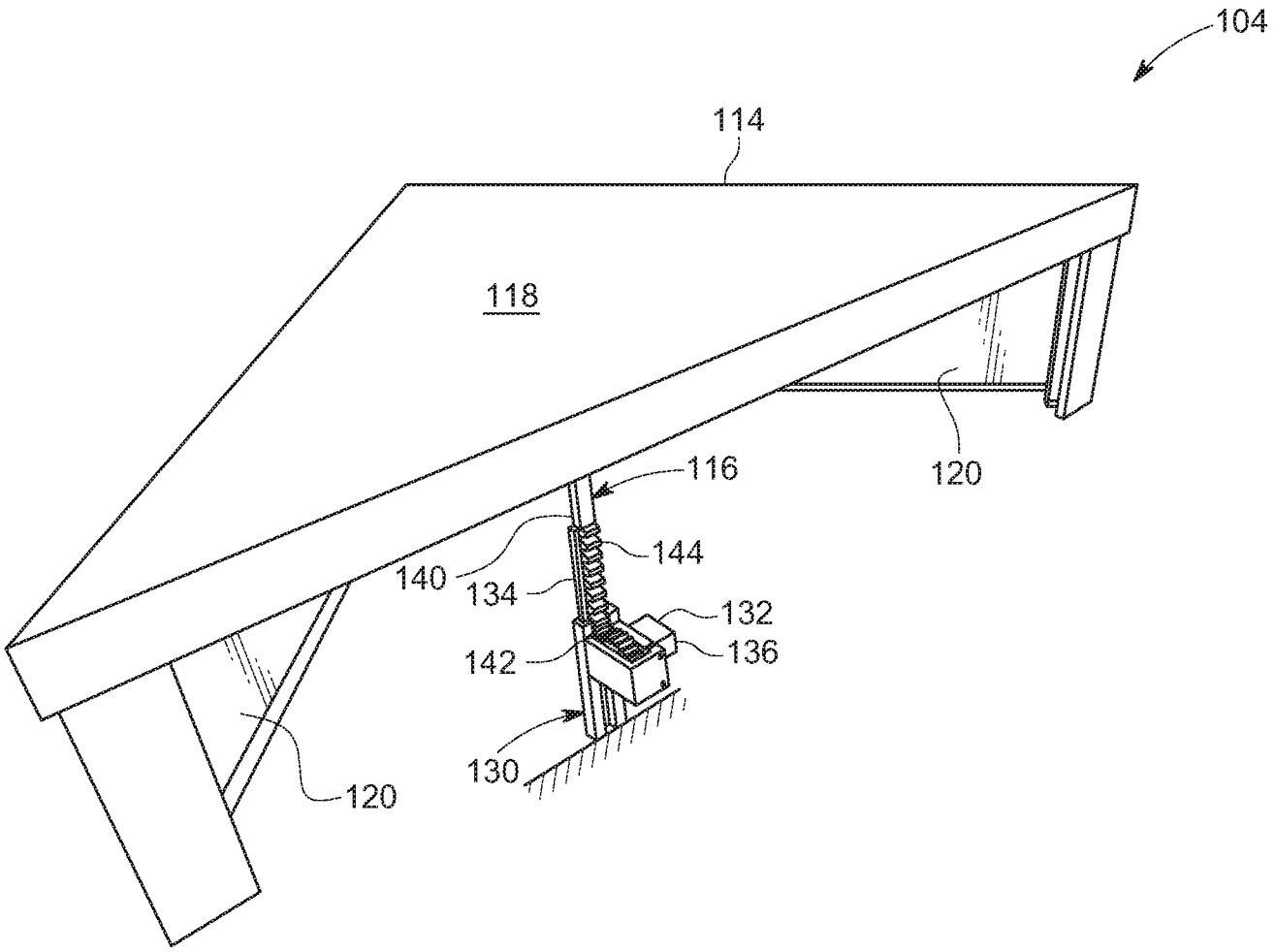
FIG. 3 illustrates a single dynamic board piece having a tile with one of side surfaces removed and a lift mechanism having a rack and pinion assembly to move the tile between a fully extended position and a fully recessed position, in accordance with an embodiment of the disclosure.

Referring to FIG. 3, the dynamic board piece 104 includes a tile 114 and a lift mechanism 116 connected to the tile 114 and adapted to move the tile between the first position and the second position. In certain implementations, the tile 114 may be removable coupled to the mechanism, and may include a top planar surface 118 and a plurality of side surfaces 120 extending substantially vertically and downwardly from the top planar surface 118. The top planar surface 118 defines a surface of the floor when the tile 114 is disposed in the second position, while the plurality of side surfaces 120 is adapted define a plurality of walls of the dynamic board piece 104 when the tile 114 is disposed in the first position. The top planar surface 118 and/or the side surfaces may have sensors and/or lights, LED, or other visual displays imbedded within or attached thereto. In an embodiment, the top planar surface 118 may be shaped as one of a right triangle, an equilateral triangle, a triangle with two interior angles measuring 45 degrees, a square, a pentagon, a hexagon, a trapezoid, and a regular polygon. In certain embodiments, the tile 114 may include a bottom planar surface (not shown) connected to the lift mechanism 116. In some embodiments, the top planar surface 118 may be coupled to and supported by the lift mechanism 116. In such a case, the bottom planar surface may be omitted.

The lift mechanism 116 may include at least one actuator assembly 130 coupled to the tile 114 and adapted to move the tile 114 between the first position and the second position. In an embodiment, the actuator assembly 130 may include an actuator 132 and a linkage assembly 134 coupled to the tile 114 and the actuator 132 for facilitating the movement of the tile 114 between the first position and the second position. In an embodiment, as shown in FIG. 3, the actuator 132 may be an motor 136, for example, an electric motor, and the linkage assembly 134 may include a rack and pinion assembly 140 having a pinion 142 mounted on a shaft of the motor 136 and rotates due to a rotation of the shaft, and a rack 144 is operatively engaged with the pinion 142 and moves linearly in response to the rotation of pinion 142. The rack 144 may be engaged with the tile 114, therefore causes the vertical movement of the tile 114.

Figure 4:
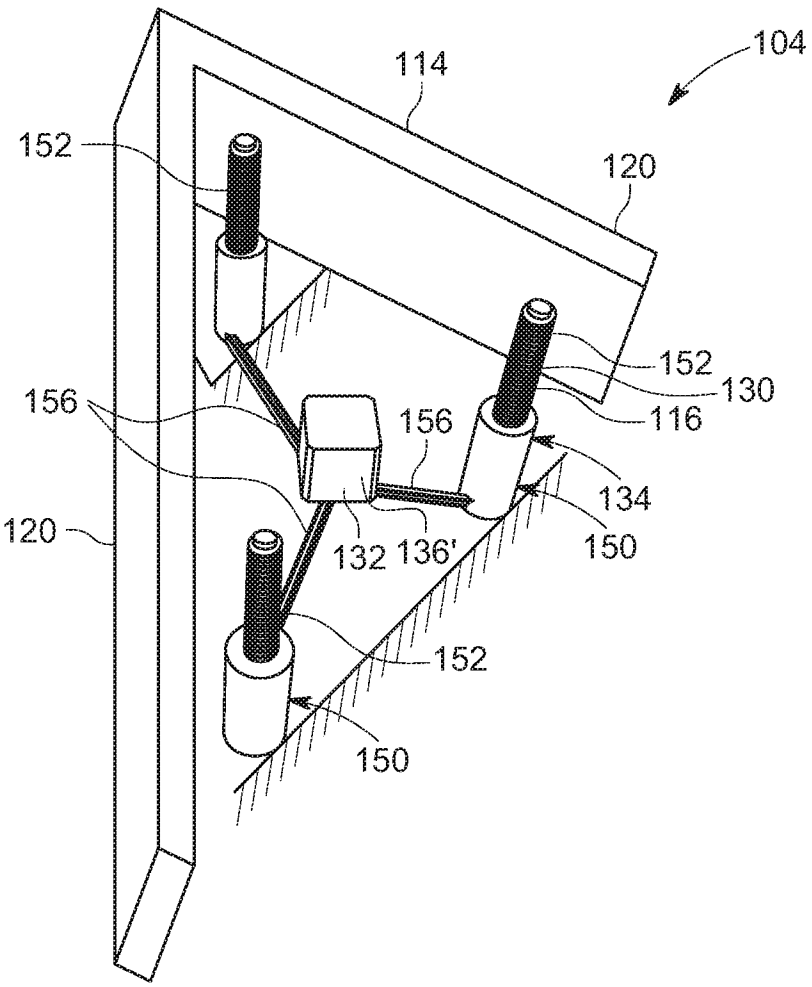
FIG. 4 illustrates a single dynamic board piece depicting a tile with a top planar surface and one of side surface removed and a lift mechanism having an actuator assembly including at least one lead screw assembly to move the tile between a fully extended position and a fully recessed position, in accordance with an embodiment of the disclosure.

In an embodiment, as shown in FIG. 4, the linkage assembly 134 may include a lead screw assembly 150 having at least one lead screw 152, for example, three lead screws 152, operatively connected to the actuator 132, for example the motor 136'. In an embodiment, each lead screw 152 are operatively connected to the motor 136' using a belt 156. In certain implementations, the motor 136' may be a stepper motor. Each lead screw 152 is connected to the tile 114 and moves linearly in response to a rotational movement of the motor 136' to facilitate the movement of the tile 114 between the first position and the second position.

Figure 5:
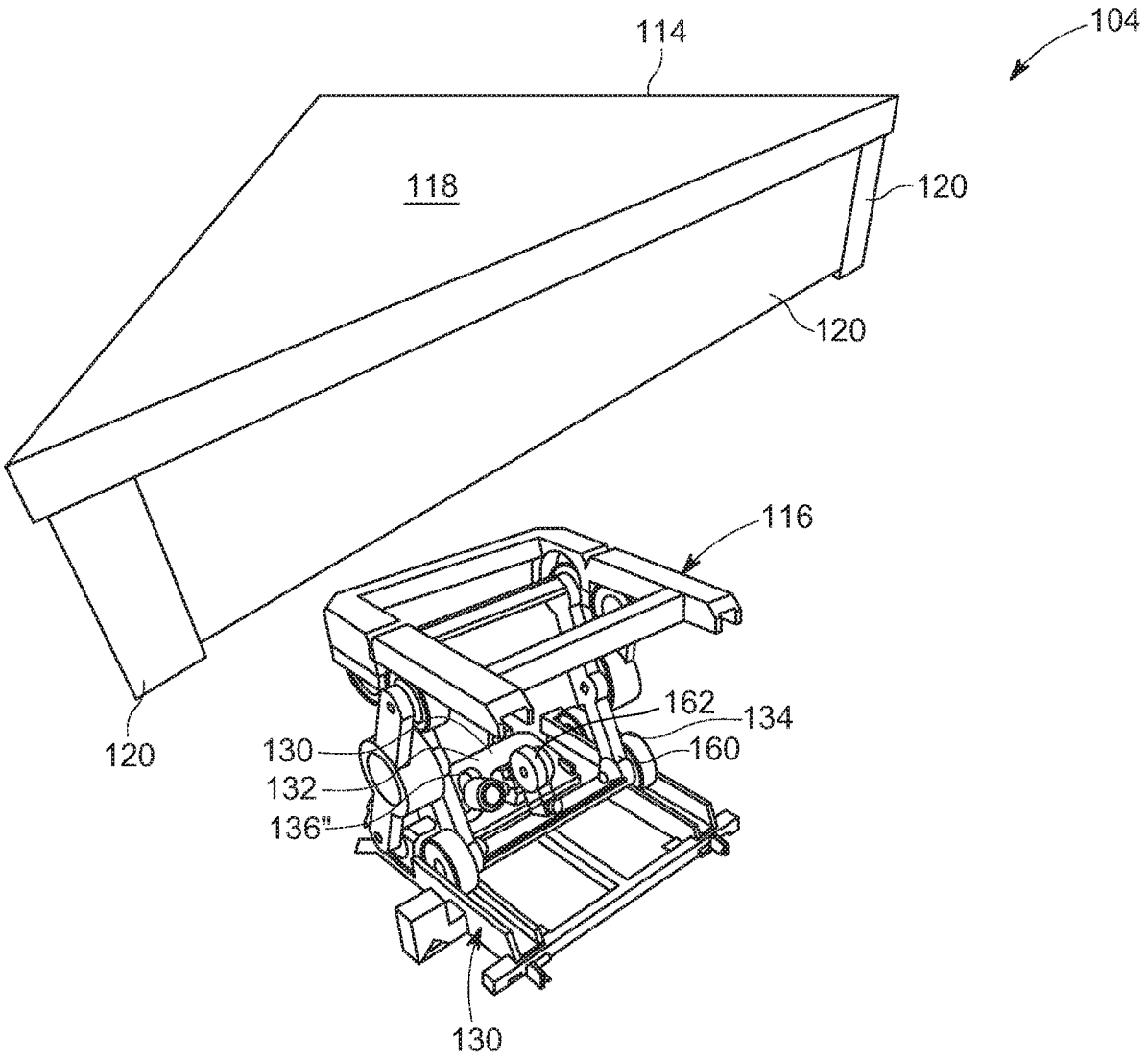
FIG. 5 illustrates an exploded view of a single dynamic board piece having a tile and a scissor lift to move the tile between a fully extended position and a fully recessed position, in accordance with an embodiment of the disclosure.

In some embodiments, as shown in FIG. 5, the linkage assembly 134 may include a scissor linkage 160 connected to the tile 114 and the actuator 132, such as, a servo motor 136" to facilitate a movement of the tile in the vertical direction. In an embodiment, the scissor linkage 160 may include a scissor lift 162 and a spring to bias the scissor lift 162 to a position corresponding to the second position of the tile 114. In another embodiment, the scissor linkage 160 may include a scissor lift 162 and a spring to bias the scissor lift 162 to a position corresponding to the first position of the tile 114. Although, the actuator 132 is contemplated as the servo motor 136", it may be appreciated any other actuator, such as, but not limited to, a fluid cylinder may also be utilized for moving the scissor lift 162.

Figure 6:
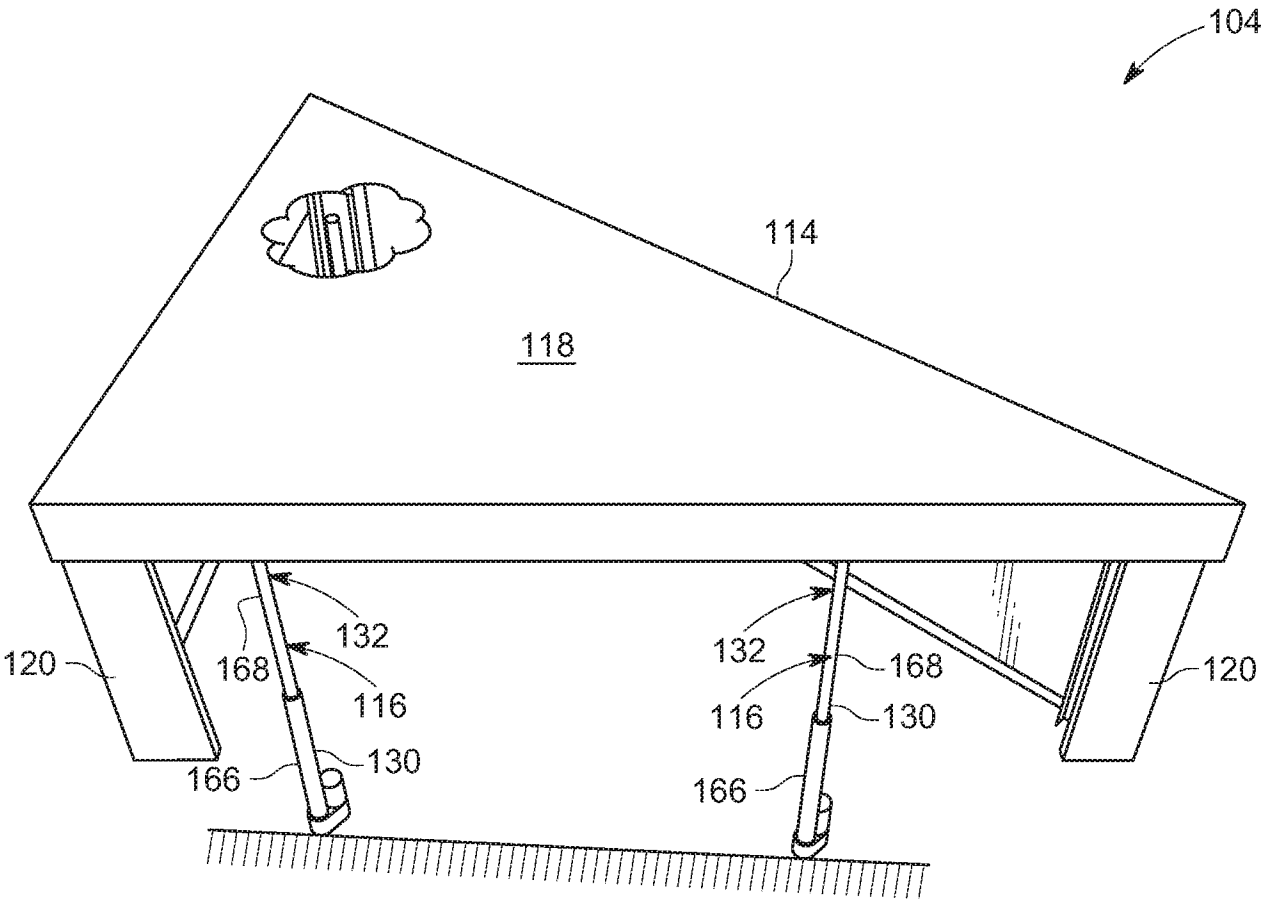
FIG. 6 illustrates a single dynamic board piece having a tile with one of side surfaces removed and an actuator as a hydraulic cylinder to move the tile between a fully extended position and a fully recessed position, in accordance with an embodiment of the disclosure.
Figure 7:
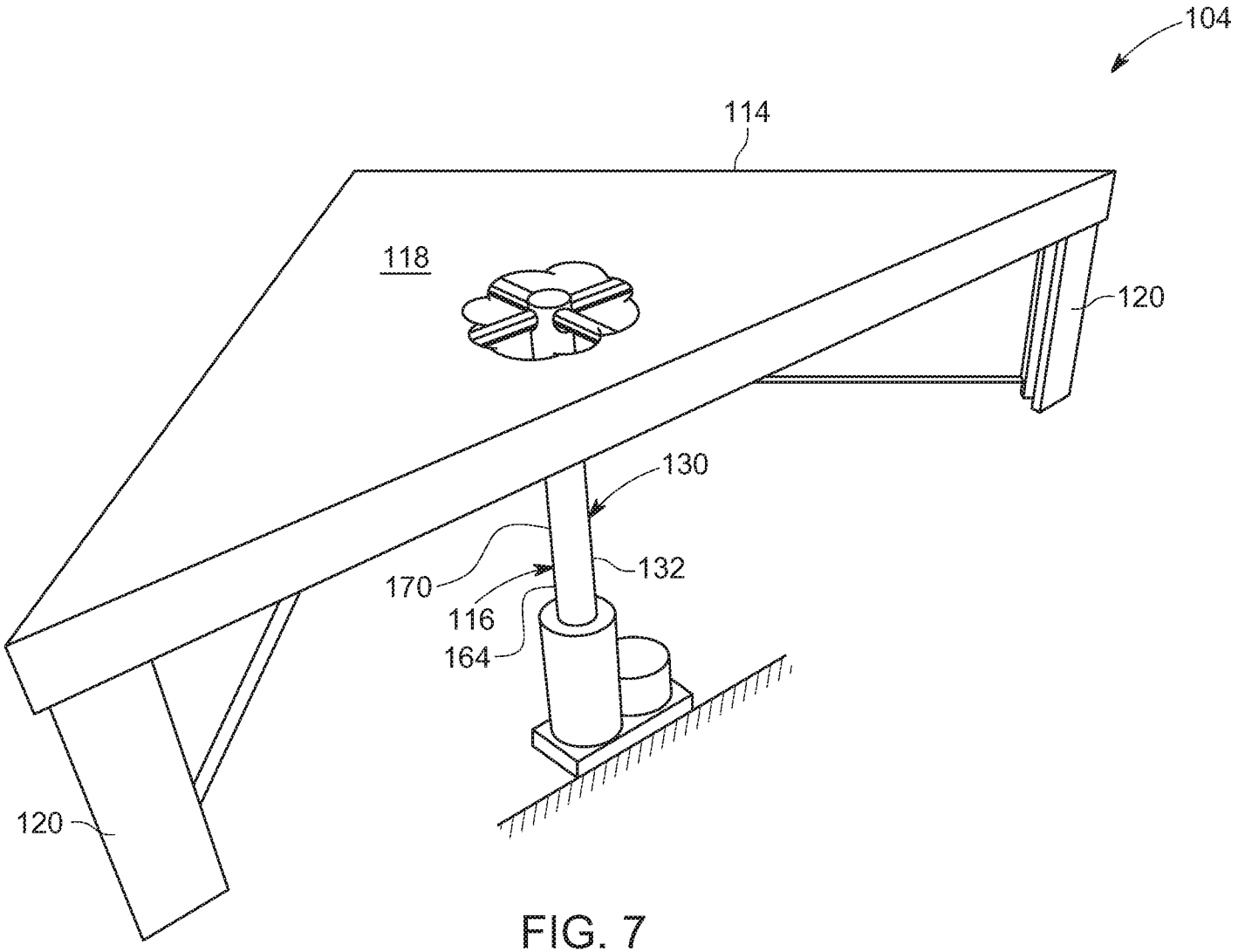
FIG. 7 illustrates a single dynamic board piece having a tile with one of side surfaces removed and an actuator as a pneumatic cylinder to move the tile between a fully extended position and a fully recessed position, in accordance with an embodiment of the disclosure.

In some embodiments, as shown in FIGS. 6 and 7, the actuator 132 may include a linear actuator, such as, but not limited to, a pneumatic cylinder 164 (shown in FIG. 7), a hydraulic cylinder 166 (shown in FIG. 6), or any other actuator suitable for moving the tile 114 between the first position and the second position. As shown, the actuator 132 may be directly connected with the tile 114, and in such a case, the linkage assembly 134 may be omitted. For example, as shown in FIG. 6, a piston 168 of the hydraulic cylinder 166 may be coupled to the tile 114 to enable a reciprocal movement of the tile 114 in the vertical direction between the first position and the second position. For so doing, the piston 168 is extended by introducing a hydraulic fluid inside the hydraulic cylinder 166 to move to tile 114 in the first position, while the piston 168 is retracted to move the tile 114 to the second position. Similar to the hydraulic cylinder 166, the pneumatic cylinder 164 (shown in FIG. 7) a piston 170 of the pneumatic cylinder 164 may be coupled to the tile 114 to enable a reciprocal movement of the tile 114 in the vertical direction between the first position and the second position. For so doing, the piston 170 is extended by introducing an air inside the pneumatic cylinder 164 to move to tile 114 in the first position, while the piston 170 is retracted to move the tile 114 to the second position.

In further embodiments, the tile 114 may be spring biased by a spring (not shown) in the second position and the actuator 132 works against the spring bias to move the tile from the second position to the first position. In this embodiment, to move the tile from the first position to the second position, the actuator de-actuates and allows the spring to move the tile to the second position. In further embodiments, the tile may further comprise a brake that holds the tile in a set position between the first and second position, inclusive, without requiring constant force from the actuator.

Figure 8:
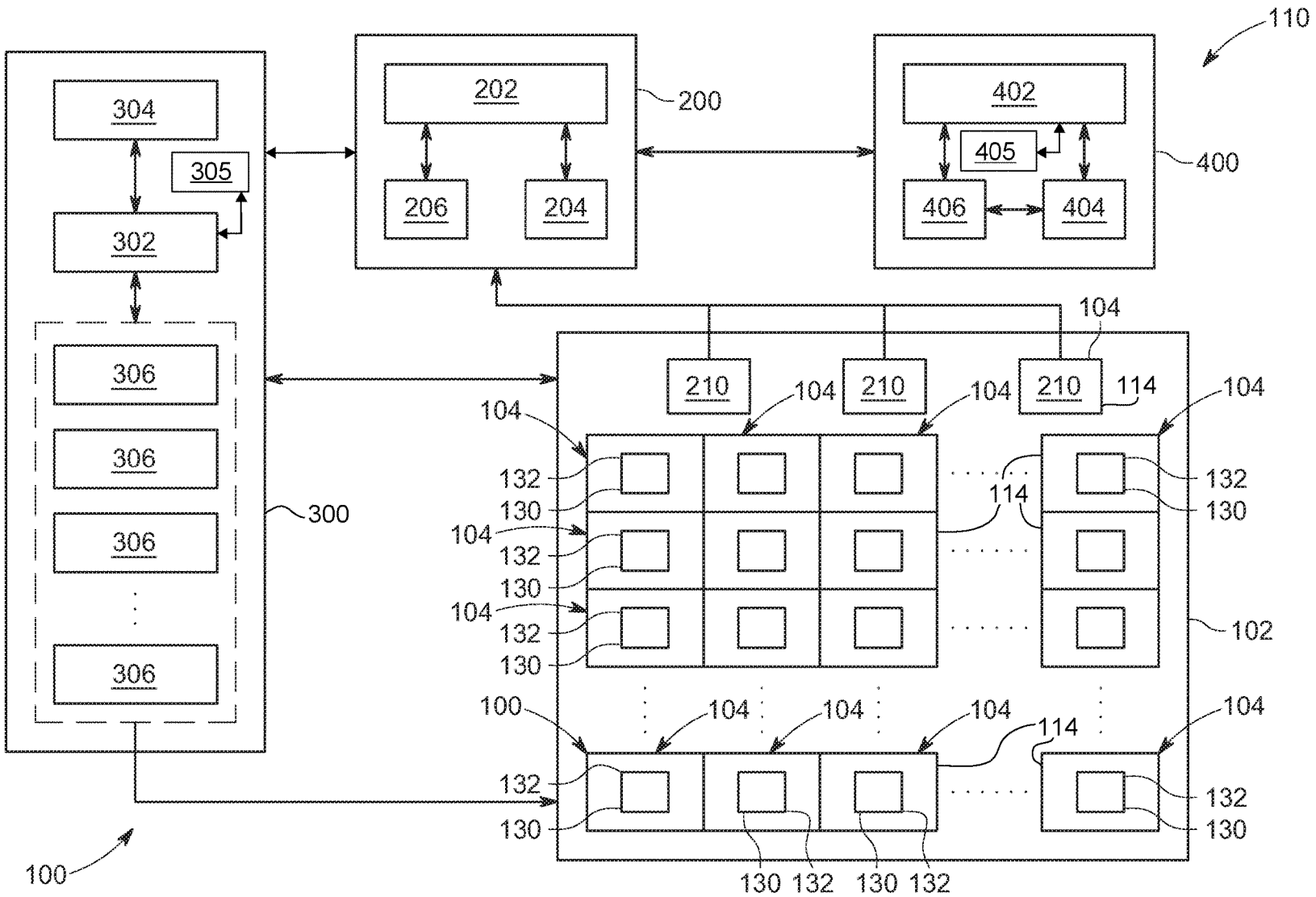
FIG. 8 illustrates an exemplary schematic view of the electronic control system adapted for controlling the movement of the plurality of dynamic board pieces, in accordance with an embodiment of the disclosure.
Figure 9:
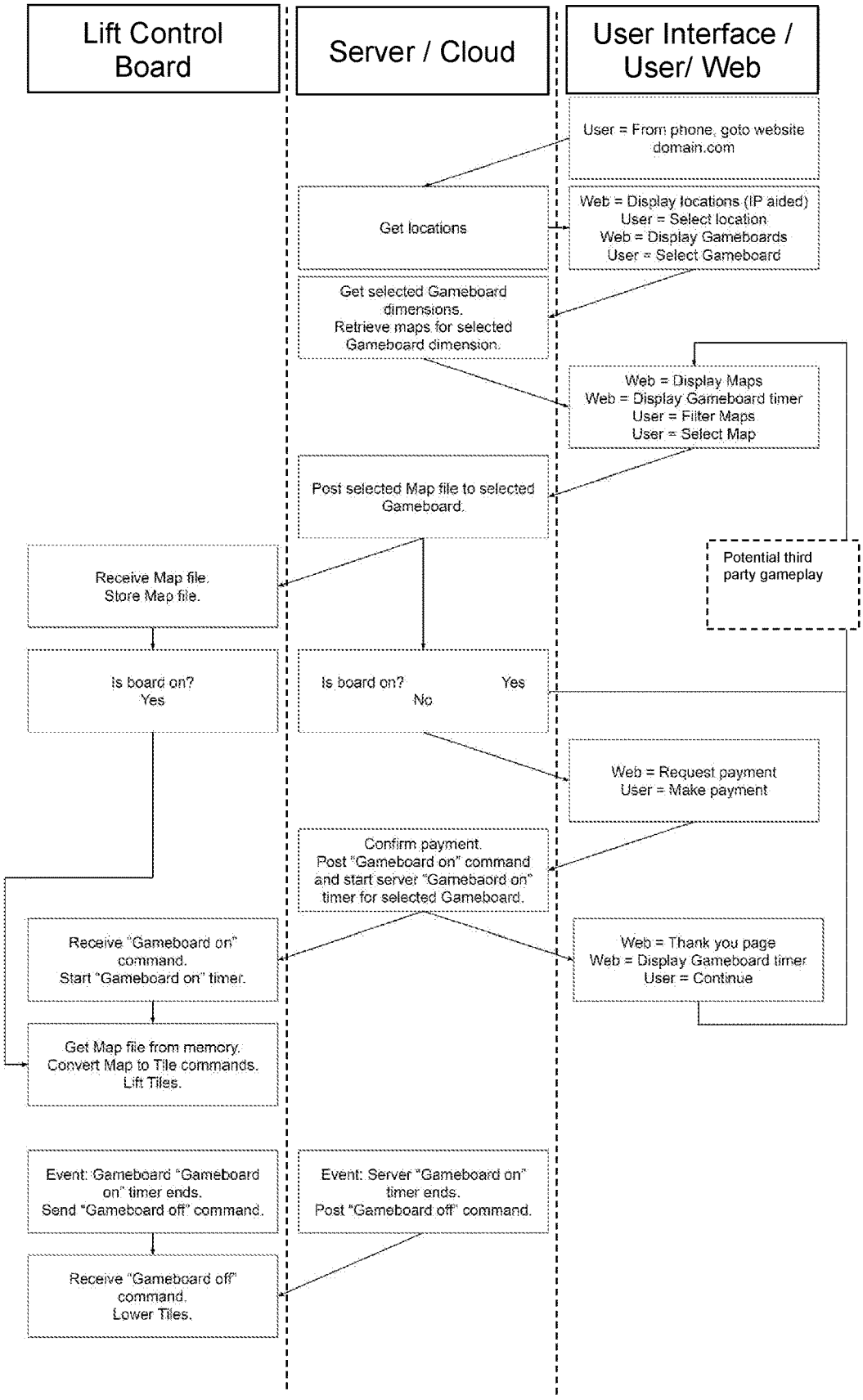
FIG. 9 is a swim diagraph showing an embodiment of a method of using the dynamic gameboard of FIG. 1.
Figure 10A:
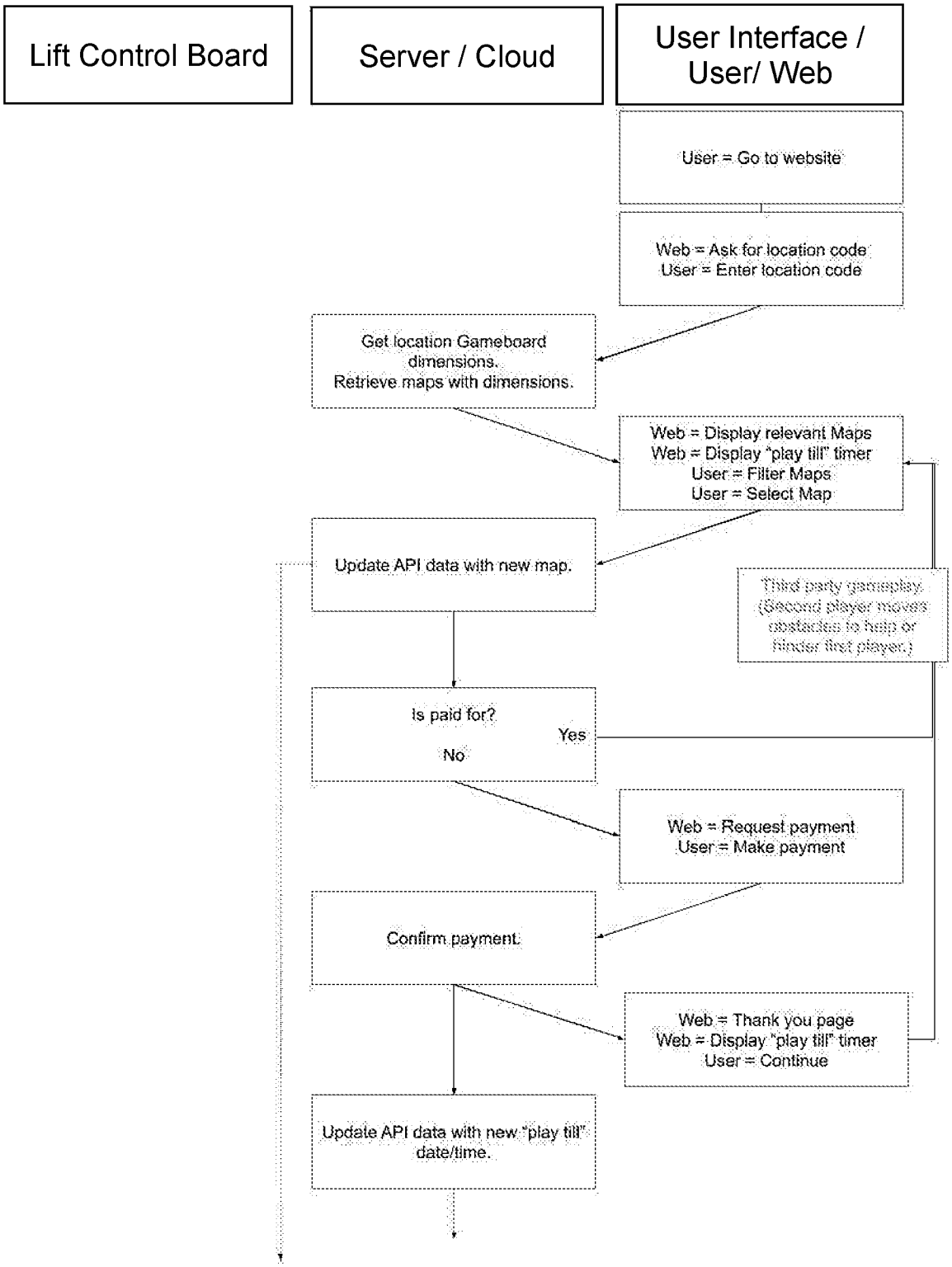
FIGS. 10A and 10B is a single swim diagraph broken over two figures showing a second embodiment of a method of using the dynamic gameboard of FIG. 1.
Figure 10B:
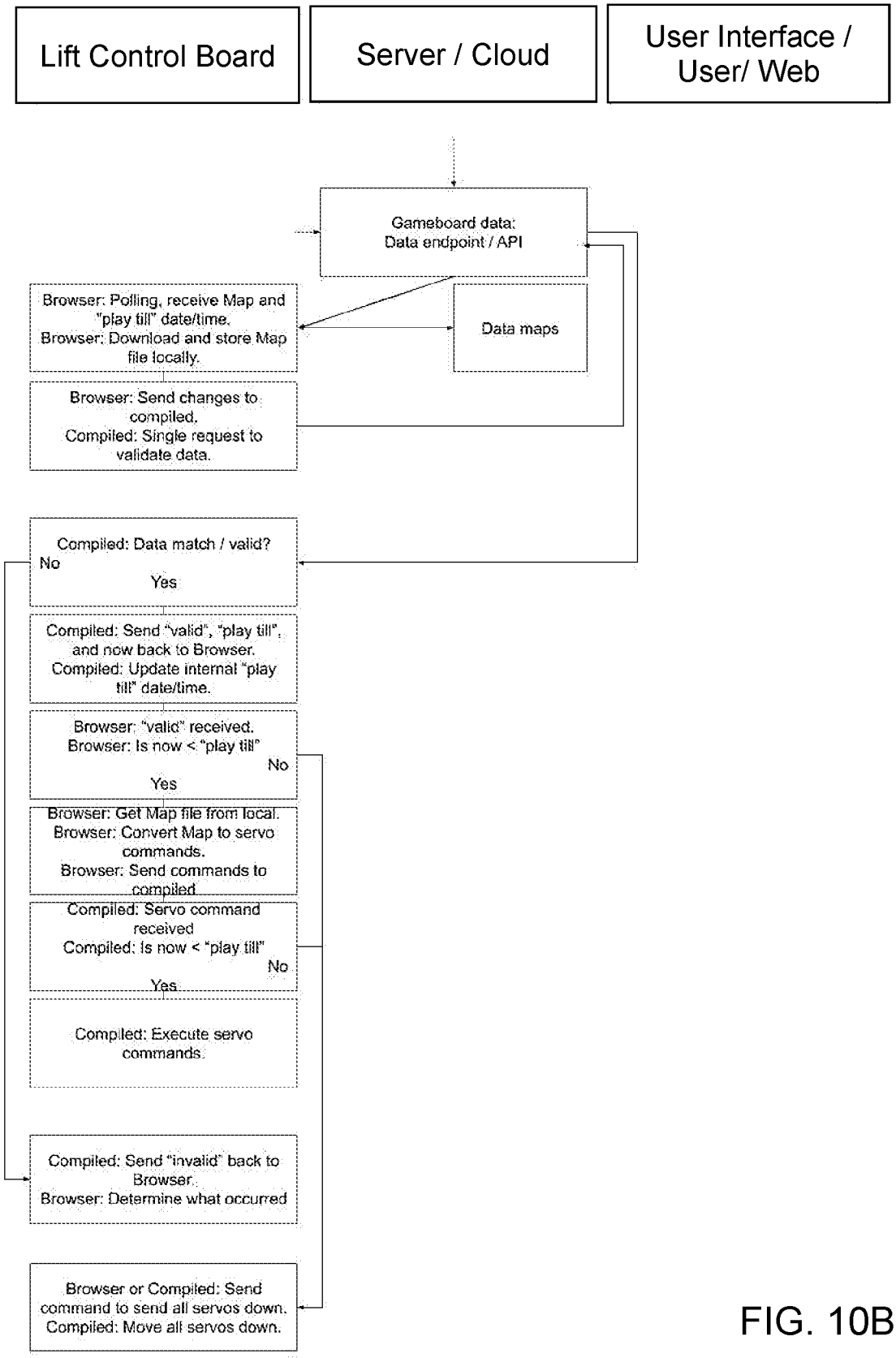

Further, the movement of the dynamic board piece 104 may be controlled by controlling each actuator 132 by the electronic control system 110. Referring to FIG. 8, the electronic control system 110 includes a server 200, a lift control board 300, and a user interface 400 for enabling an operator to provide one or more instructions to the server 200 and/or the lift control board 300 for controlling movement of one or more dynamic board pieces 104 of the gameboard 100. The user interface may be directly electrically connected to the server 200, the lift control board 300, and/or the board 102, or it may be connected wirelessly and/or through a network, such as a private network, a local area network, the world wide web, and the internet. In one embodiment, the user interface 400 may be a portable electronic device, such as a cellular phone, smart phone, tablet computer, laptop computer, or other portable electronic device. In other embodiments, the user interface may be a desktop computer. As shown, the server 200 may be located at location remote from the plurality of dynamic board pieces 104 and the lift control board 300, and includes a first processor 202, a first memory 204, and a first communication device 206, adapted to facilitate a communication and data exchange between the server 200 and the lift control board 300 and the server 200 and the user interface 400. The first processor 202 may be a microprocessor and is adapted to fetch one or more instructions stored in the first memory 204 and command the movement of the one or more tiles 114 (i.e. the one or more dynamic board pieces 104) via the lift control board 300, which controls the movements of the one or more tiles 114. In an embodiment, the first processor 202 may also command the movement of one or more tiles 114 of the one or more dynamic board pieces 104 based on one or more inputs received from the user interface 400. Further, the first processor 202 is adapted to display, via the user interface 400, one or more maps (including, for example, paths, levels, and courses) to the user. The one or more maps include one or more paths, a position of each tile 114 on the board 102, changes in positions of the tiles 114 based on the time duration elapsed since a start of the play, based on a position of the user and or other objects on the board 102, based on predefined tile movement patterns, and/or based on one or more instructions according to which the user plays on the gameboard 100.

In an embodiment, the user may select a map, stored in the first memory 204, having positions of each tile 114 of the board 102 based on one or more inputs received from user via the user interface 400. In such a case, the first processor 202 may command the movement of each tile 114 and the of position each tile 114 according to the positions stored in the map. Further, in certain embodiments, the first processor 202 may dynamically command the positions of the tiles 114 based on the data stored in the map to provide one or more paths 105 for the movement of the user and/or other object on the board 102, while obstructing other paths 105 for the movement of the user and/or other object on the board 102. In an embodiment, the first processor 202 may be in communication with a plurality of sensors 210 of the electronic control system 110 to detect a position of the user and/or other object on the board 102, a direction of the movement of the user and/or other object on the board 102, and/or a speed of the movement of the user and/or other object on the board 102. The first processor 202 may command one or more dynamic board pieces 104 based on the data received from the sensors 210 to dynamically change the position of the tiles 114, and hence dynamically change the path, by commanding the associated lift mechanism 116, creating real-time gameplay, for example. In some embodiments the sensors 210 may be alternatively or additionally spaced from the tiles 114, for example, along the walls of the board 102, beneath the tiles, or above the tiles spaced from the board 102, and the sensors 210 may detect impact and or pressure on the tiles 114, such as when the tiles 114 are struck by an object.

The first processor 202 may be operatively connected to the first memory 204 for storing instructions related to the control of the gameboard 100 and associated components. The first memory 204 as illustrated is separate from the first processor 202, but those skilled in the art will understand that the first memory 204 may be integrated into the first processor 202, while still being accessible by the first processor 202 and/or the lift control board 300 to store information in and retrieve information from the first memory 204 as necessary during the operation of the gameboard 100. In an embodiment, the first memory 204 may store various maps that can be selected by the user through the user interface 400 according to the which the user can play on the board 102. Further, the first memory 204 may include various data related to payment and access to the gameboard 100. In an embodiment, the first memory 204 may store information related to the durations of play corresponding to the payment information. Further, the first memory 204 is adapted to store instantaneous position of each tile 114 when the play on the board is active. The instantaneous positions of each tile 114 may be stored for a predetermined time duration. The first memory 204 may be accessed by the user via the user interface 400 to scan and view the one or maps.

The user interface 400 may include a third processor, a display 405 and one or more input devices 404 through which the user can enter or select various instructions or information stored in the first memory 204 to enable a playing of a game on the board 102. In an embodiment, the user may enter a payment information, via the one or more input devices 404, to enable the user to make a payment for facilitating the user to play the game. In certain implementations, the user interface 400, via the display 405, may display various maps stored into the first memory 204 to facilitate the user in accessing various maps and in selecting the map according to which the user wants to play the game. The display 405 may be an LCD display, a LED display, a handheld device screen, or any other suitable display adapted to show/display the position and the movement of the one or more tiles 114 and the position and movement of the user on the board 102. The user interface 400 may also be in communication with the first processor 202 and receive information from the first processor 202 to display via the display 405. To facilitate an access of the first memory 204 and receive information from the first processor 202 and/or the first memory 204, the user interface 400 may include a communication device 406 (hereinafter referred to as a third communication device 406) that communicates with the first communication device 206.

Moreover, the lift control board 300 is in communication with the first processor 202, the first memory 204, via a second communication device 305, and each actuator 132 associated with each tile 114 and control an activation and a deactivation of each actuator 132 based on the inputs received from the first processor 202. For so doing, the lift control board 300 may include a second processor 302, a second memory 304, a second communication device 305, and a plurality of on-off switches 306 to control power provided to each actuator 132. It may be appreciated that one on-off switch 306 may associated with all the actuators 132 associated with a single tile 114. The on-off switches are operated by the second processor 302 based on the instructions received from the first processor 202 to control activation and de-activation of the actuators 132. In this manner, a vertical position of each tile 114 is controlled to ensure positioning of each dynamic board piece 104 in a fully extended position, a fully recessed position, or a partially extended position according to instructions received from the first processor 202 based on the map selected by the user through the user interface 400. Accordingly, the lift control board 300 facilitates in defining one or more paths 105 across the board 102 that the user needs to navigate to reach a final position from an initial position.

Also, the lift control board 300 is in communication with each actuator 132 associated to control a direction, speed, and distance of motion of each lift mechanism 116, and hence each tile 114 as per the instructions received from the first processor 202. For example, the second processor 302 may control the motor 136, 136', 136" to control or move a direction, speed, and distance of motion of the associated lift mechanism 116. In one embodiment, the server 200 does not need to know an identification number of the various tiles 114 or motors 136, 136', 136". The server 200 need only send positional data—x and y of a tile 114 for example and desired first or second position, or some position in between first and second position. When the lift control board 300 receives that data, the lift control board 300 translates the data to the identification number of the motor 136, 136', 136" (or other lift) and decides how power should be supplied to accomplish the command, such as motor turns, fluid added, just for example. For so doing, in one such embodiment, each motor of the gameboard is assigned an identification number, and the first processor 202 sends instructions (data) to the second processor 302 that includes the tile 114 location and respective desired first or second position, or location between first and second position. The lift control board 300 then retrieves the assigned identification number of the motors 136, 136', 136" from the second memory 304, determines the directions of rotation of the motors, and number of rotations of the motors to raise the tiles 114 or lower the tiles 114. In a further embodiment, each motor of the gameboard is assigned an identification number, and the first processor 202 of the server 200 sends instructions (data) to the second processor 302 of the lift control board 300 that includes the identification numbers of the motors 136, 136', 136", directions of rotation of the motors 136, 136', 136", and number of rotations of the motors 136, 136', 136" to raise the tiles 114 or lower the tiles 114. For controlling the hydraulic or pneumatic actuators 164, 166 (depicted as hydraulic or pneumatic cylinders 164, 166, which may be two way and/or spring biased cylinders), the second processor 302 of the lift control board 300 may increase or decrease pressure/fluid inside the hydraulic cylinder 166 or the pneumatic cylinder 164. In an embodiment, the second processor 302 of the lift control board 300 may monitor a total current drawn by the board 102 and/or a total pressure of fluid drawn by the board 102 for operating or moving a number of dynamic board pieces 104 between the first position and the second position. For so doing, in an implementation, the lift control board 300 may include one or more current sensors and/or one or more pressure sensors. In some implementations, the second processor 302 of the lift control board 300 may determine a total number of the dynamic board pieces 104 that are being operated or moved between the first position and second position and vice versa, and determine the total current or total pressure of the fluid drawn by the board 102. The second processor 302 of the lift control board 300 restricts the movement of the one or more of the dynamic board pieces 104 if a value of the total current drawn by the board is above a threshold value or a value of the total pressure of the fluid is above a threshold value.

An exemplary method for operating the gameboard 100 is explained now. To initiate a play on the gameboard 100, the user may access the user interface 400 and connect to the server 200, to access various locations at which the board 102 is present or accessible, and enters or selects the location, by using the one or more input devices 405, at which user wishes to play the board 102. Upon receiving the details of the location from the user, the first processor 202 may show, via the display 405, one or more maps available to play corresponding to the location, where the input device 405 and the display 405 may both be a touch screen. Subsequently, or otherwise, the user may select a map among the one or more maps displayed by the display 405. In an embodiment, in addition to the location, the user may choose/select/or enter dimensions, for example, a length and a width and/or number of tiles, of the board 102 on which the user wishes to play. In such a case, the first processor 202 may display, via the display 405, one or more maps corresponding to the chosen location and dimensions.

Upon receiving a selection of the map by the user, the first processor 202 may associate the selected map to the selected board 102 and may share a file/data associated to the map with the second processor 302 of the lift control board 300. In an embodiment, before sharing the file/data with the second processor of the lift control board 300, the first processor 202 may communicate with the lift control board 300 and may check if the board 102 is switched on or switched off. In response to the switched off condition of the board 102, the first processor 202 may send a signal to the second processor 302 to switch on the board 102 to enable a delivery of power to the actuator assembly 130 of the lift mechanism 116 of each dynamic board piece 104. For so doing, in some scenarios, the user may be required to make a payment. To this end, the first processor 202 may prompt the user, via the user interface 400, for making the requisite payment. Upon receiving the requisite payment, first processor 202 may send a signal to switch on the board 102 to receive the file associated with the map and to enable a delivery of power to the actuator assemblies 130.

After receiving the file/data associated with the map, the second processor 302 starts a timer, and positions one or more tiles 114 to provide one or more paths 105 to a player to navigate the course to reach a final position from an initial position and to provide obstructions in the form of raised dynamic board pieces 104 in the path 105 of the player. For so doing, the second processor 302, in communication with the first processor 202 and according to the received file/data, moves one or more tiles 114 to the fully recessed position, to the fully extended position, or any position between the fully extended position or the fully recessed position as required by the map. The second processor 302 moves the one or more tiles by sending commands to the associated actuators 132. In an embodiment, the commands are generated, by the second processor 302, based on the files for the selected map. Further, the second processor 302 may change the positions of the one or more tiles 114 of the dynamic board pieces 104 based on the time elapsed since the start of the timer as defined by the selected map. Further, in an embodiment, the second processor 302 in communication with the server 200 may receive data associated with the position of the user, the direction of movement of the user and/or other object, and/or the speed of movement of the user and/or other object, and change the position of one or more tiles 114 of the dynamic board pieces 104 to dynamically change a course/path 105 to be navigated by the player/user to reach the final position. In an embodiment, the second processor 302 may continue to monitor the timer and calculate a time duration from the initiation of the play, and may indicate an end of the game upon an elapse of a predetermined time duration. In some embodiments, the second processor 302 may store the total time taken by the player to reach the final position to the initial position for each game and share the information with the server 200, which stores the information in the first memory 204. Upon completion of the game, the second processor 302 or the first processor 202 may indicate the end of the play and move the board to an off position. For so doing, the second processor 302 or the first processor 202 may move all the tiles 114 to the second position (i.e., the fully recessed position), and subsequently switch off the board 102. In an embodiment, the board 102 is switched-off by moving each switch 306 to disable power or distribute power to the associated actuator assembly 130 to achieve a fully recessed position. In this manner, the gameboard 100 facilitates an interactive play of the game.

The first, second, and third memories 204, 304, 404 may be non-volatile memories. Although the first, second, and third processors 202, 302, 402 are contemplated as microprocessors, it is also possible and contemplated to use other electronic components such as a microcontroller, an application specific integrated circuit (ASIC) chip, or any other integrated circuit device.

The invention illustratively disclosed herein suitably may explicitly be practiced in the absence of any element which is not specifically disclosed herein. While various embodiments of the present invention have been described in detail, it is apparent that various modifications and alterations of those embodiments will occur to and be readily apparent those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items while only the terms "consisting of" and "consisting only of" are to be construed in the limitative sense.

Wherefore, I claim:

1. A dynamic gameboard comprising:

an electronic control system; and a board having a plurality of dynamic board pieces;

wherein the electronic control system includes a server, lift control board and a user interface, the server having a first processor, a first memory, and a first communication device, wherein instructions are stored on the first memory to cause the first processor to direct the lift control board to instruct the plurality of dynamic board pieces to move between a first position and a second position, and between the second position and the first position, where the first position is a fully extended up position and the second position is a fully recessed down position; the lift control board having a second processor, a second memory, and a second communication device, and the user interface having a third processor, a third memory, and a third communication device; and wherein the plurality of dynamic board pieces includes a plurality of tiles and a respective lift mechanism that raises and lowers each tile and the dynamic board pieces supports an adult human weight standing on the board when the tiles are both in the first position and the second position, and the plurality of tiles are spring biased to the second position.

2. The method dynamic gameboard of claim 1 wherein the tile has a substantially planar top surface and substantially planar side surfaces, and the top surface is shaped as one of a right triangle, an equilateral triangle, a triangle with two interior angles measuring 45 degrees, a square, a pentagon, a hexagon, a trapezoid, and a regular polygon.

3. The dynamic gameboard of claim 1 wherein the lift mechanism includes one of a pneumatic piston, a hydraulic piston, a lead screw, a scissor lift, a linear actuator, rack and pinon, a worm screw, a servo, a motor, and a geared servo.

4. The dynamic gameboard of claim 1, wherein the lift mechanism including three lead screws arranged at a periphery of the tile, and a stepper motor functionally connected to the three lead screws via a belt.

5. The dynamic gameboard of claim 1, wherein the lift mechanism including a scissor lift, a servo, and a spring, wherein the spring biases the scissor lift in one of the first position and the second position.

6. The dynamic gameboard of claim 1, wherein the plurality of tiles is arranged such that when one or more tiles are raised adjacent to one or more tile that is lowered, the raised tiles define a wall and the lowered tiles defines a floor.

7. The dynamic gameboard of claim 1 further comprising sensors that sense movement of an object across the board, wherein the sensors relay data to the second processor and instructions stored in the second memory direct one or more of the plurality of tiles to move in an upward or downward position in response to sensor data.

8. The dynamic gameboard of claim 7 wherein the sensors are embedded in one or more of the plurality of tiles.

9. The dynamic gameboard of claim 1, wherein the second memory stores instructions to direct one or more of the plurality of tiles to continuously move between the first position and the second position.

10. The dynamic gameboard of claim 1, wherein the second memory stores instructions to direct one or more of the plurality of tiles to move to and maintain for a period of time a position that is between the up position and down position.

11. The dynamic gameboard of claim 1 wherein the second memory stores instructions to direct a plurality of tiles to move from the first position to the second position and back in a manner that creates a dynamic obstacle on the gameboard.

12. A method for a user to operate a dynamic gameboard, the dynamic gameboard having an electronic control system and board, the board having a plurality of dynamic board pieces, the method comprising:

connecting to a server via a user interface over a network, the server including a first processor, a first memory, and a first communication device, the user interface including a display; an input device, a third processor, a third memory, and a third communication device, the first communication device adapted to facilitate a communication and data exchange between the server and the user interface and between the server and a lift control board, and the third communication device adapted to facilitate a communication and data exchange between the user interface and the server, the lift control board having a second processor, a second memory, and a second communication device, the second communication device adapted to facilitate a communication and data exchange between the lift control board and the server;

the first processor accessing, via the first memory, one or more locations at which a board is available, and sending the one or more locations from the server to the user interface;

selecting on the user interface a chosen location via the input device, and sending the location from the user interface to the server;

the first processor accessing, via the first memory, one or more maps available to play at the chosen location and sending the one or more maps from the server to the user interface;

selecting on the user interface a map among the one or more maps via the input device, and sending a map selection from the user interface to the server;

the first processor associating the selected map to a board at the selected location;

the first processor sending a file associated to the selected map from the first memory to second processor of the lift control board, and the lift control board storing the map file in the second memory; and after receiving the file associated with the map, the second processor starts a timer, and positions one or more tiles to provide one or more paths to a player to navigate a course to reach a final position from an initial position and to provide obstructions in as raised dynamic board pieces in the path of the player;

where a first position of a tile is a fully extended up position and a second position of the tile is a fully recessed down position.

13. The method of claim 12 further comprising the second processor, in communication with the first processor and according to the file associated with the map, moves one or more tiles to a fully recessed position, to a fully extended position, or a position between the fully extended position or the fully recessed position as directed by the map by sending commands to associated actuators of the dynamic board pieces.

14. The method of claim 13 further comprising the second processor changing positions of the one or more tiles of the dynamic board pieces based on a time elapsed since the start of the timer as defined by the selected map.

15. The method of claim 13 further comprising the second processor receiving sensor data associated with one of a position of the user or another object on the board, a direction of movement of the user or another object on the board, and a speed of movement of the user or another object, and based on the sensor data changing a position of one or more tiles of the dynamic board pieces to dynamically change a path to be navigated by the user to reach a final position.

16. The method of claim 15, further comprising the second processor continuing to monitor the timer and calculate a time duration from an initiation of play, and indicating an end of game upon an elapse of a predetermined time duration, the second processor storing a total time taken by the player to reach the final position for a game and sharing a time duration information with the server, which stores the time duration information in the first memory; and upon completion of the game, the second processor or the first processor indicating and end of the play and moving the board to an off position by the second processor or the first processor moving all the tiles to the second position, and subsequently switching off the board by moving each switch in the lift control board to disable power to associated actuator assemblies.

17. The method of claim 12, further comprising the first processor prompting the user, via the user interface, for making a requisite payment, and upon receiving the requisite payment, first processor sending a signal to switch on the board to receive the file associated with the map and to enable a delivery of power to associated actuator assemblies; and before sharing the map file with the second processor, the first processor communicates with the lift control board and checks if the board is switched on or switched off, and in response to the switched off condition of the board, the first processor sends a signal to the second processor to switch on the board to enable a delivery of power to an actuator assembly of a lift mechanism of each dynamic board piece.

18. A dynamic gameboard comprising:

an electronic control system including a server, lift control board and a user interface;

a board having a plurality of dynamic board pieces;

wherein the electronic control system includes a server, lift control board and a user interface, the server having a first processor, a first memory, and a first communication device, wherein instructions are stored on the first memory to cause the first processor to direct the lift control board to instruct the plurality of dynamic board pieces to move between a first position and a second position, and between the second position and the first position, where the first position is a fully extended up position and the second position is a fully recessed down position; the lift control board having a second processor, a second memory, and a second communication device, and the user interface having a third processor, a third memory, and a third communication device;

the dynamic board piece includes a plurality of tiles and a respective lift mechanism that raises and lowers each tile;

the tile has a substantially planar top surface and substantially planar side surfaces, and the top surface is shaped as one of a right triangle, an equilateral triangle, a triangle with two interior angles measuring 45 degrees, a square, a pentagon, a hexagon, a trapezoid, and a regular polygon;

the lift mechanism includes one of three lead screws arranged at a periphery of the tile, and a stepper motor functionally connected to the three lead screws via a belt, a scissor lift, a servo, and a spring, wherein the spring one of biases the scissor lift in the first position and the second position, a pneumatic piston, a hydraulic piston, a rack and pinon, a worm screw, and a geared servo;

the plurality of tiles is arranged such that when one or more tiles are raised adjacent to one or more tile that is lowered, the raised tiles create a wall and the lowered tiles create a floor;

sensors that sense movement of an object across the board, wherein the sensors relay data to the second processor and instructions stored in the second memory direct one or more of the plurality of tiles to move in an upward or downward position in response to sensor data, and the sensors are embedded in one or more of the plurality of tiles;

the second memory stores instructions to direct one or more of the plurality of tiles to continuously move between the up position and down position;

the second memory stores instructions to direct one or more of the plurality of tiles to move to and maintain for a period of time a position that is between the first position and second position, the period of time being one of between 1 and 5 seconds, 30 seconds and 2 minutes, and greater than 2 minutes; and the board supports a 200-pound adult human standing on the board when the tiles are both in the up position and the down position.

* * * * *